US007874284B2

(12) United States Patent
Sano

(10) Patent No.: US 7,874,284 B2
(45) Date of Patent: Jan. 25, 2011

(54) FUEL SUPPLY SYSTEM HAVING FUEL FILTER INSTALLED DOWNSTREAM OF FEED PUMP

(75) Inventor: Atsushi Sano, Toyoake (JP)

(73) Assignee: Denso Corporation, Kariya (JP)

( * ) Notice: Subject to any disclaimer, the term of this patent is extended or adjusted under 35 U.S.C. 154(b) by 273 days.

(21) Appl. No.: 12/326,360

(22) Filed: Dec. 2, 2008

(65) Prior Publication Data

US 2009/0145402 A1 Jun. 11, 2009

(30) Foreign Application Priority Data

Dec. 5, 2007 (JP) ..... 2007-314629

(51) Int. Cl.
*F02M 37/04* (2006.01)
*F02M 37/00* (2006.01)

(52) U.S. Cl. ..... 123/511; 123/459

(58) Field of Classification Search ..... 123/511, 123/456, 447, 196 A, 457, 459, 510, 514, 123/508, 446; 417/286
See application file for complete search history.

(56) References Cited

U.S. PATENT DOCUMENTS 6,289,875 B1 9/2001 Shinohara et al.
7,077,107 B2 * 7/2006 Boos et al. ..... 123/446
7,128,054 B2 * 10/2006 Koehler et al. ..... 123/446
7,343,901 B2 * 3/2008 Mori et al. ..... 123/446
2005/0022794 A1 * 2/2005 Piet ..... 123/510
2008/0149204 A1 6/2008 Shimai
2008/0156295 A1 7/2008 Suzuki et al.
2008/0178845 A1 7/2008 Shimai

FOREIGN PATENT DOCUMENTS

JP 2000-240531 9/2000
JP 2006-207499 8/2006
JP 2008-157277 7/2008
JP 2008-180208 8/2008
JP 2008-208826 9/2008

* cited by examiner

*Primary Examiner*—Mahmoud Gimie
(74) *Attorney, Agent, or Firm*—Nixon & Vanderhye PC

(57) ABSTRACT

A fuel supply system for an accumulator fuel injection system designed to inject fuel, as stored in an accumulator, into an internal combustion engine through a fuel injector The fuel supply system includes a feed pump working to pump the fuel out of a fuel tank and a fuel filter disposed between the feed pump and a high-pressure pump working to deliver the fuel to the accumulator. The fuel supply system also includes a return path and a control valve. When the pressure of the fuel between the fuel filter and the flow rate control valve exceeds a first set pressure, the control valve opens the return path to return the fuel from downstream to upstream of the feed pump to keep the pressure of fuel supplied to the flow rate control valve below the first set pressure, thereby controlling the flow rate of the fuel passing through the fuel filter.

5 Claims, 13 Drawing Sheets

FUEL SUPPLY SYSTEM HAVING FUEL FILTER INSTALLED DOWNSTREAM OF FEED PUMP

CROSS REFERENCE TO RELATED DOCUMENT

The present application claims the benefit of Japanese Patent Application No. 2007-314629 filed on Dec. 5, 2007, the disclosures of which are incorporated herein by reference.

BACKGROUND OF THE INVENTION

1. Technical Field of the Invention

The present invention relates generally to a fuel supply system which may be employed in automotive common rail fuel injection systems, and more particularly to such a fuel supply system which is equipped with a fuel filter installed downstream of a feed pump and designed to have a simple structure which ensures the mountability thereof in vehicles and may be produced at a low cost.

2. Background Art

Typical fuel supply systems for use in accumulator fuel injection systems for diesel engines are equipped with a high-pressure pump, a feed pump, a suction control valve (i.e., a flow rate control valve), and a fuel filter. The high-pressure pump works to pressurize and deliver fuel to a common rail in which the fuel is accumulated at a controlled high pressure. The feed pump works to pump the fuel out of a fuel tank and feed it to the high-pressure pump. The suction control valve works to control the flow rate of the fuel to be fed from the feed pump to the high-pressure pump. The fuel filter is equipped with a filter medium to filter the fuel. The capturing of smaller foreign objects is achieved by decreasing the mesh size of the filter medium. This, however, gives rise to the problem of increasing a loss of the pressure of fuel passing through the fuel filter and also results in an increased possibility of clogging of the fuel filter. The fuel usually becomes wax-like at low temperatures, thus resulting in an increased loss of the pressure of the fuel passing through the fuel filter, which leads to decreased performance or failure in operation of the feed pump.

In order to avoid the above drawbacks, Japanese Patent First Publication No. 2006-207499 teaches a fuel supply system designed to have the fuel filter disposed downstream of the feed pump to develop a greater difference in pressure across the fuel filter than when the fuel filter is disposed upstream of the feed pump. This allows the mesh size of the filter medium to be decreased to improve the ability of the fuel filter to trap foreign objects and also minimizes the deterioration in performance or the failure in operation of the feed pump when the fuel filter is clogged or the fuel becomes wax-like at the low temperatures.

The fuel supply system in which the fuel filter is disposed downstream of the feed pump, however, encounters the drawback in that a total production cost is increased due to two factors, as discussed below.

The first is the need for disposing two valves: one upstream and the other downstream of the fuel filter. Specifically, a pressure control valve is used to stabilize or keep the pressure of fuel between the fuel filter and the suction control valve at a set level in order to ensure the accuracy in controlling the flow rate of the fuel through the suction control valve. A relief valve is used to return an excess of the fuel to upstream of the feed pump to control the flow rate of the fuel passing through the fuel filter in order to avoid the breakage or early clogging of the filter medium.

The second is associated with the fuel priming after the engine is installed in the vehicle. Specifically, after the fuel supply system is joined to the engine, a fuel pipe between the fuel tank and the feed pump and the fuel filter usually need to be filled with fuel in order to ensure the stability in starting the engine. It is easy for the fuel supply pump in which the fuel filter is disposed downstream of the feed pump to fill the fuel pipe with the fuel between the fuel tank and the feed pump, but however, it is difficult to fill the fuel filter with the fuel because the feed pump installed upstream of the fuel filter is small in area of an internal fuel path thereof. The fuel supply system is, therefore, designed to have a bypass path extending directly to the fuel filter to fill the fuel filter with the fuel and a check valve installed in the bypass path, which leads to the increase in production cost of the fuel supply system.

The use of the pressure control valve, the relief valve, the bypass path, and the check valve also results in a complicated structure of the fuel supply system and decreased mountability thereof in the vehicle.

SUMMARY OF THE INVENTION

It is an object of the invention to provide a simple structure of a fuel supply system for vehicles which is equipped with a fuel filter disposed downstream of a feed pump working to pump fuel out of a fuel tank and designed to ensure the mountability thereof in vehicles and may be produced at a low cost.

According to one aspect of the invention, there is provided a fuel supply system for an accumulator fuel injection system such as a common rail fuel injection system for automotive diesel engines and designed to inject fuel, as stored in an accumulator, into an internal combustion engine through a fuel injector. The fuel supply system comprises: (a) a feed pump working to pump fuel out of a fuel tank through a first fuel path and feed the fuel to a second fuel path; (b) a high-pressure pump working to pressurize and supply the fuel, as fed from the feed pump through the second fuel path, to the accumulator; (c) a fuel filter disposed in the second fuel path between the feed pump and the high-pressure pump to filter the fuel, as delivered from the feed pump to the high-pressure pump; (d) a flow rate control valve disposed in the second fuel path between the fuel filter and the high-pressure pump to control a flow rate of the fuel delivered to the high-pressure pump; (e) a return path extending from between the feed pump and the fuel filter to the first fuel path which is upstream of the feed pump; and (f) a control valve working to open and close the return path selectively. When the pressure of the fuel in the second fuel path between the fuel filter and the flow rate control valve exceeds a first set pressure, the control valve is placed in an open position to open the return path to return the fuel from downstream to upstream of the feed pump to keep the pressure of fuel between the fuel filter and the flow rate control valve below the first set pressure.

Specifically, the control valve serves as a pressure control valve to stabilize or keep the pressure of fuel between the fuel filter and the flow rate control valve at a desired level and a relief valve to control the flow rate of the fuel flowing into the fuel filter. This results in a simplified structure of the fuel supply system which may be produced at a low cost and also improves the mountability of the fuel supply system in vehicles.

In the preferred ode of the invention, the control valve includes a first valve element and a second valve element. The first valve element being subjected to the pressure of the fuel between the fuel filter and the flow rate control valve. When the pressure of the fuel between the fuel filter and the flow rate control valve exceeds the first set pressure, the first valve element is moved to open the return path. The second valve element is subjected to a pressure of the fuel between the feed pump and the fuel filter. When the pressure of the fuel between the feed pump and the fuel filter exceeds a second set pressure, the second valve element is moved to open the return path. Specifically, when the fuel filter is clogged, so that the pressure of fuel upstream of the fuel filter rises, the second valve element works to drop the pressure of fuel upstream of the fuel filter to upstream of the feed pump.

The first valve element may have a communicating hole formed therein as a portion of the return path. The second valve element is disposed in the communicating hole to open and close the return path selectively.

The first valve element may alternatively be designed to have a length made up of a first cylindrical body, a second cylindrical body, and a third cylindrical body. The second cylindrical body is located between the first and third cylindrical bodies and smaller in diameter than the first cylindrical body. The third cylindrical body is smaller in diameter than the second cylindrical body. The second valve element is made of a ring-shaped member which is greater in outer diameter than the second cylindrical body and in which the third cylindrical body is fit slidably. The control valve includes a first spring urging the first valve element toward the second valve element and a second spring urging the second valve element toward the first valve element. An end of the first cylindrical body is exposed to the pressure of the fuel between the fuel filter and the flow rate control valve. An end of the second valve element is exposed to the pressure of the fuel between the feed pump and the fuel filter. When the pressure of the fuel between the fuel filter and the flow rate control valve exceeds the first set pressure, the first and second valve elements are moved together to open the return path. When the pressure of the fuel between the feed pump and the fuel filter exceeds the second set pressure, the second valve element is moved away from the first valve element to open the return path.

The fuel supply system may further include a priming pump which is disposed in the first fuel path between the fuel tank and the feed pump and works to pump the fuel out of the fuel tank and feed the fuel. The return path serves to return the fuel from between the feed pump and the fuel filter to between the priming pump and the feed pump. The third cylindrical body of the first valve element or the second valve element has a communicating path which is to communicate at ends thereof with the return path. When the second cylindrical body of the first valve element is placed in abutment with the second valve element, the communicating path is closed. When the second cylindrical body of the first valve element is placed away from the second valve element, the communicating path is opened. The second cylindrical body has an outer shoulder surface which faces the second valve element and on which a pressure of the fuel, as fed from the priming pump, is exerted through the communicating path, so that the pressure of the fuel, as fed from the priming pump, urges the second cylindrical body of the first valve element away from the second valve element to open the return path through the communicating path.

When it is required to prime the fuel in the fuel filter, and the pressure of fuel, as pumped by the priming pump, rises, the control valve opens the return path to supply the fuel to the fuel filter. This eliminates the need for an additional priming bypass filter and a check valve.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 10(*b*) is a bottom view of FIG. 10(*a*);

FIG. 12(*b*) is a bottom view of FIG. 12(*a*);

FIG. 13(*b*) is a bottom view of FIG. 13(*a*);

FIG. 14(*b*) is a bottom view of FIG. 14(*a*).

DESCRIPTION OF THE PREFERRED EMBODIMENTS

Figure 1:
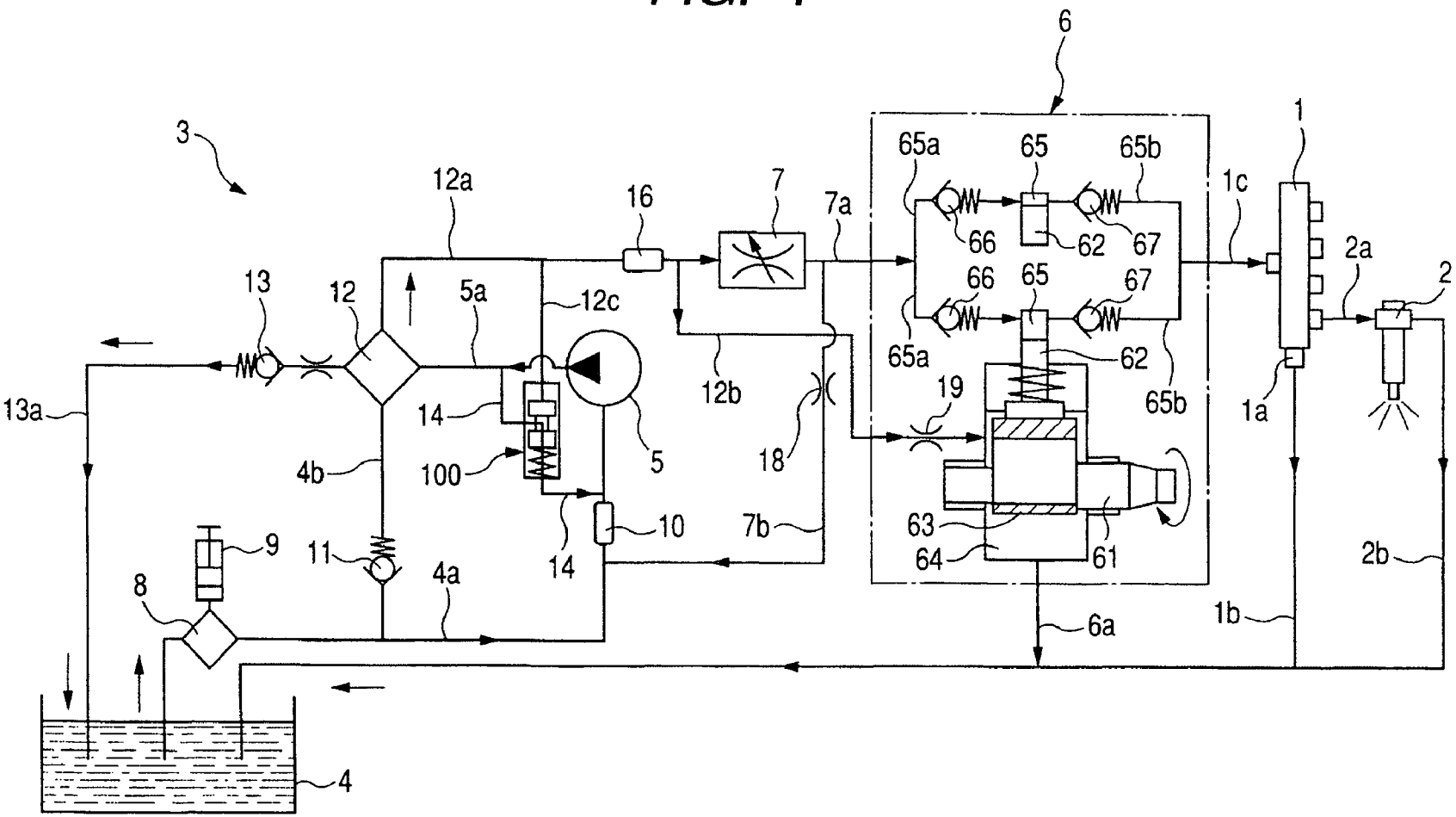
FIG. 1 is a block diagram which shows an accumulator fuel injection system equipped with a fuel supply system according to the first embodiment of the invention.

Referring to the drawings, wherein like reference numbers refer to like parts in several views, particularly to FIG. 1, there is shown an accumulator fuel injection system such as a common rail fuel injection system for automotive diesel engines equipped with a fuel supply system 3 according to the first embodiment of the invention.

The accumulator fuel injection system is used with a four-cylinder diesel engine (not shown) and equipped with a common rail 1, fuel injectors 2 (only one is illustrated), and the fuel supply system 3. The fuel injectors 2 are installed one for each cylinder of the diesel engine and work to spray the fuel, as supplied from the common rail 1, into the engine. The fuel supply system 3 supplies the fuel to the common rail 1.

The common rail 1 works as an accumulator to store the fuel, as delivered from the fuel supply system 3, at a controlled target pressure which is determined by an electronic control unit (ECU) not shown as a function of an operating condition of the diesel engine which is represented, for example, by an open position of an accelerator pedal and the speed of the diesel engine.

The common rail 1 has installed therein a pressure limiter 1*a* which is to be opened to release the fuel from the common rail 1 when the pressure of fuel in the common rail 1 exceeds an upper limit. The released fuel is returned back to a fuel tank 4 of the fuel supply system 3 through a fuel pipe 1*b*.

The fuel injector 2 is supplied with the fuel from the common rail 1 through a high-pressure pipe 2*a*. An excess of the fuel not having been sprayed from the fuel injector 2 is returned back to the fuel tank 4 through a fuel pipe 2*b*. The fuel injector 2 is connected electrically to the ECU. The ECU controls the injection timing and quantity of the fuel to be injected by the fuel injector 2 into the diesel engine.

The fuel supply system 3 includes the fuel tank 4, a feed pump 5, a high-pressure pump 6, and a suction control valve 7. The feed pump 5 sucks the fuel from the fuel tank 4 and delivers it to the high-pressure pump 6. The high-pressure pump 6 pressurizes the fuel, as delivered from the feed pump 5, and supplies it to the common rail 1. The suction control valve 7 function as a flow rate control valve to control the flow rate of fuel supplied from the feed pump 5 to the high-pressure pump 6.

The feed pump 5 connects with the fuel tank 4 through an inlet pipe 4*a* to pump the fuel out of the fuel tank 4 and deliver it to the high-pressure pump 6. The feed pump 5 of this embodiment is implemented by a trochoid pump that is an internal gear pump. The feed pump 5 is joined to a camshaft 61 of the high-pressure pump 6 so that it is driven by torque transmitted from the camshaft 61.

A pre-filter 8 and a priming pump 9 are installed in the inlet pipe 4*a*. The pre-filter 8 works to filter foreign objects from the fuel pumped out of the fuel tank 4. The priming pump 9 feeds the fuel primary to the inlet pipe 4*a* from the fuel tank 4 after the vehicle is assembled. A gauze filter 10 is installed in the inlet pipe 4*a* closer to an inlet of the feed pump 5 to filter foreign objects from the fuel flowing downstream of the pre-filter 8. The pre-filter 8 and the gauze filter 10 may be made of a metallic mesh.

A bypass path 4*b* is connected to a portion of the inlet pipe 4*a* which is downstream of the pre-filter 8 and upstream of the gauze filter 10. The bypass path 4*b* is used to feed the fuel, as pumped by the priming pump 9, downstream of the feed pump 5. The bypass path 4*b* has disposed therein a check valve 11 which checks the flow of the fuel to the inlet pipe 4*a*.

A fuel filter 12 is connected downstream of the feed pump 5 through a fuel path 5*a*. The fuel filter 12 works to filter the fuel, as delivered from the feed pump 5. The fuel filter 12 is equipped with a relief valve 13 which is opened to release the fuel from the fuel filter 12 when the pressure of fuel passing through the fuel filter 12 exceeds a preset level. Specifically, when opened, the relief valve 13 drains the part of the fuel, as outputted from the feed pump 5, to the fuel tank 4 through a fuel drain pipe 13*a*.

The relief valve 13 is designed to be opened when the pressure of fuel acting on the fuel filter 12 exceeds the level which is higher than the pressure of fuel discharged from the feed pump 5 when the diesel engine is idling and lower than or equal to a withstanding upper limit pressure of the fuel filter 12. The relief valve 13 serves to avoid the exertion of an excessive pressure of the fuel discharged from the feed pump 5 on the fuel filter 12.

The fuel filter 12 is subjected to the pressure of fuel discharged from the feed pump 5 and, thus, may be made of a filter medium which is smaller in mesh size, that is, higher in filtration than the pre-filter 8 and the gauze filter 10 in order to capture small foreign objects or water which the pre-filter 8 and the gauze filter 10 can't remove from the fuel.

The suction control valve 7 is connected downstream of the fuel filter 12 through a fuel path 12*a*. A gauze filter 16 is installed in the fuel path 12*a*. The gauze filter 16 may be made of a metallic mesh. The suction control valve 7 is implemented by a linear solenoid-operated valve whose open position is regulated continuously or linearly in response to a control signal outputted from the ECU as a function of the operating condition of the diesel engine.

A fuel path 12*b* is connected to a portion of the fuel path 12*a* which is downstream of the gauze filter 16 and upstream of the suction control valve 7 to direct the fuel to a cam chamber 64 of the high-pressure pump 6 which will be described later in detail.

The high-pressure pump 6 is Joined downstream of the suction control valve 7 through a fuel path 7*a*. A fuel path 7*b* is connected to the fuel path 7*a* through an orifice 18 to return the fuel to upstream of the gauze filter 10. For instance, when the suction control valve 7 is in a closed position, an excess of fuel flowing downstream of the suction control valve 7 is returned to upstream of the feed pump 5 through the fuel path 7*b*.

A return path 14 extends to connect between the fuel path 5*a* and a portion of the inlet pipe 4*a* which is upstream of the feed pump 5 and downstream of the gauze filter 10. The return path 14 has installed therein a control valve 100 which works to open or close the return path 14 selectively.

To the control valve 100, the pressure of fuel lying between the fuel filter 12 and the suction control valve 7 is inputted through a fuel path 12*c* diverging from between the fuel filter 12 and the suction control valve 7 (more specifically between the fuel filter 12 and the gauze filter 16). When the pressure of fuel between the fuel filter 12 and the suction control valve 7 exceeds a first set pressure, the control valve 100 works to open the return path 14. The control valve 100 will be discussed later in more detail.

The high-pressure pump 6, as indicated by a broken line in FIG. 1, includes the camshaft 61 driven by the output torque of the diesel engine and two plungers 62 (only one is shown for the brevity of illustration) reciprocating following rotation of the camshaft 61 within cylinders. The plungers 62 are opposed in alignment with each other in a radius direction of the camshaft 61 so that they move in a suction or a compression (i.e., a discharge) stroke alternately.

The camshaft 61 has a cam 63 fit thereon which works to convert the rotation of the camshaft 61 into linear motion of the plungers 62. The cam 63 is disposed in the cam chamber 64 formed in a pump housing of the high-pressure pump 6. The fuel flowing into the cam chamber 64 through the fuel path 12*b* is used as lubricant for the cam 63 and the plungers 62.

An orifice 19 is disposed in the fuel path 12*b* to keep the flow rate of the fuel supplied to the cam chamber 64 at a selected value. An excess of the fuel overflowing out of cam chamber 64 is returned back to the fuel tank 4 through a fuel path 6*a*.

Pressure chambers 65 are defined in the cylinders within which the plungers 62 are disposed. The volume of each of the pressure chambers 65 is changed by the reciprocating motion of a corresponding one of the plungers 62. An inlet path 65*a* and an outlet path 65*b* are connected to each of the pressure chambers 65. The inlet path 65*a* connects with the fuel path 7*a* to supply the fuel to the pressure chamber 65. The outlet path 65*b* connects with a fuel path 1*c* and outputs the fuel from the pressure chamber 65 to the common rail 1.

Inlet valves 66 are disposed one in each of the inlet paths 65*a*. The inlet valves 66 are opened when the fuel is sucked into the pressure chambers 65. Outlet valves 67 are disposed one in each of the outlet paths 65*b* The outlet valves 67 are opened when the fuel is discharged to the common rail 1 through the fuel path 1*c*.

Figure 2:
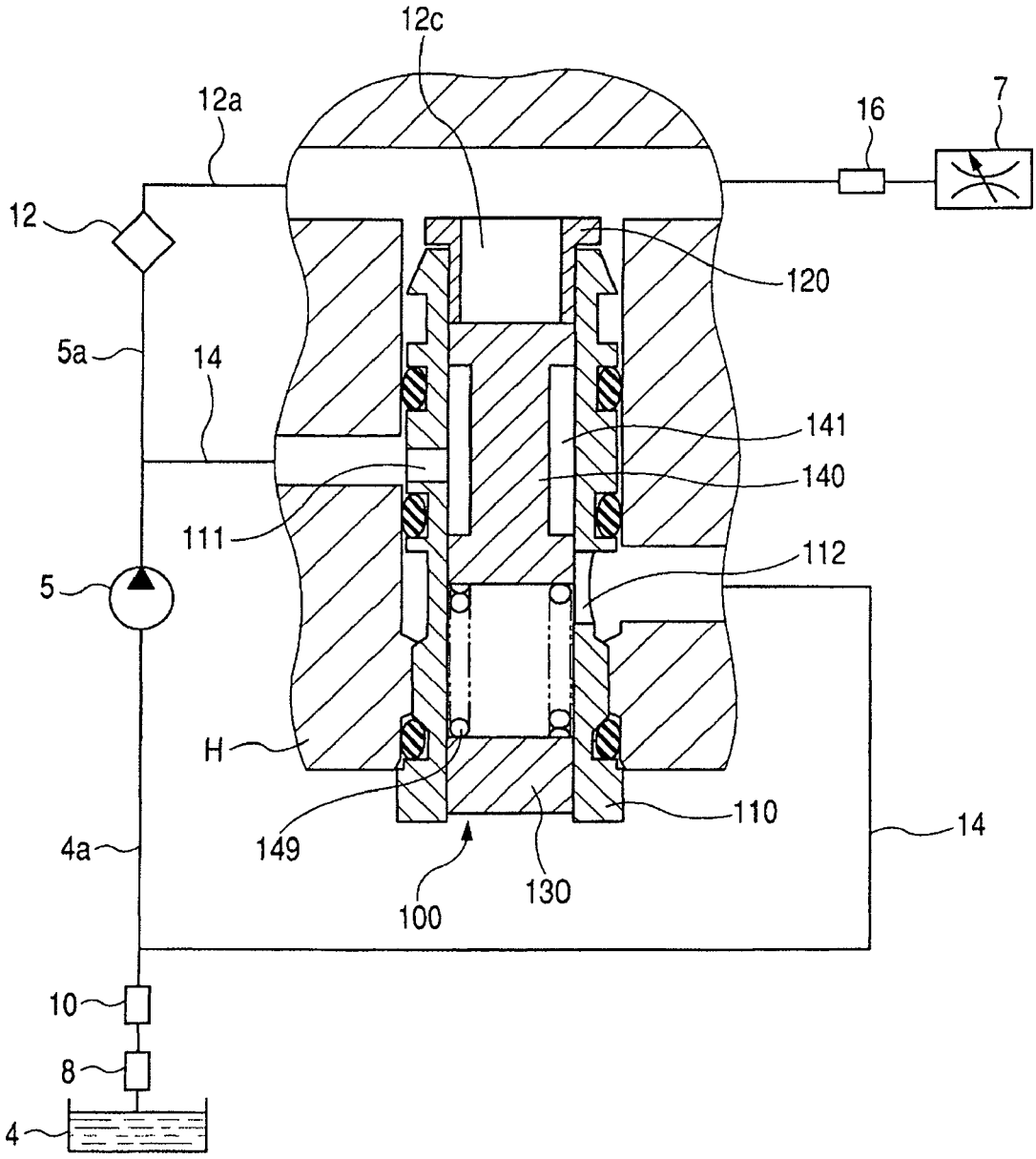
FIG. 2 is a partially sectional view which illustrates an internal structure of a control valve which is installed in the fuel supply system of FIG. 1 and placed in a closed position.
Figure 3:
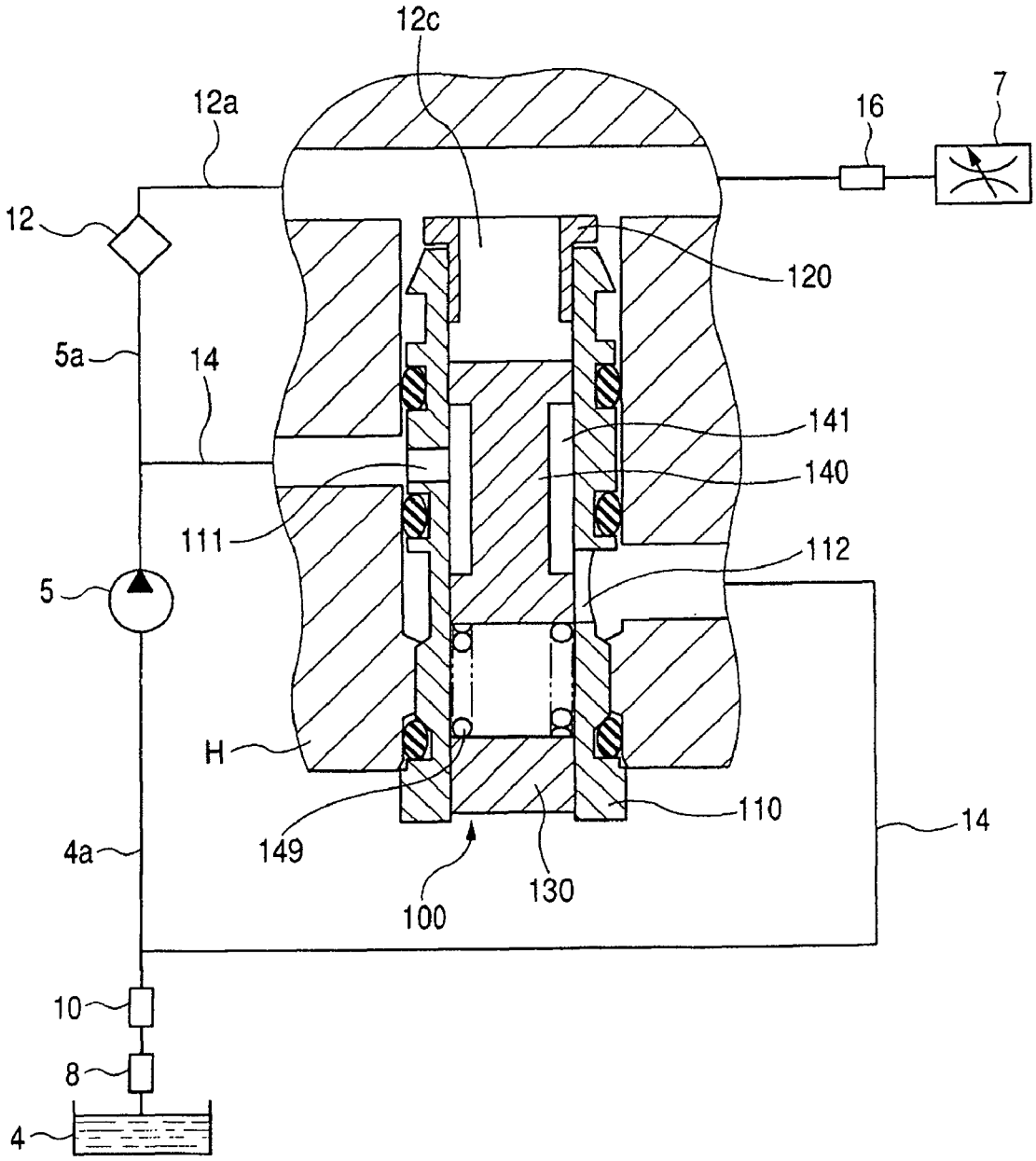
FIG. 3 is a partially sectional view which illustrates an internal structure of a control valve which is installed in the fuel supply system of FIG. 1 and placed in an open position.

FIG. 2 is a partially sectional view which illustrates an internal structure of the control valve 100 placed in a closed position. FIG. 3 is a partially sectional view which illustrates an internal structure of the control valve 100 placed in an open position.

The control valve 100 is equipped with a sleeve 110 fit in a housing H in a screw fashion. A hollow cylindrical stopper 120 is fit in an open end of the sleeve 110. The open end of the sleeve 110 is joined to the fuel path 12*a* between the fuel filter 12 and the suction control valve 7 through the fuel path 12*c* extending through the stopper 120. A plug 130 is fit in the other open end of the sleeve 110 to close it.

The sleeve 110 has two through holes 111 and 112 formed in a side wall thereof in misalignment in a radius direction of the sleeve 110. In other words, the holes 111 and 112 are at different longitudinal positions such that they do not overlap in the longitudinal direction of the sleeve 110. The hole 111 (which will also be referred to as a first sleeve hole below) closer to the stopper 120 is joined to the fuel path 5*a* between the feed pump 5 and the fuel filter 12 through the return path 14. The hole 112 (which will also be referred to as a second sleeve hole below) closer to the plug 130 is joined to the inlet pipe 4*a* between the feed pump 5 and the fuel tank 4 through the return path 14.

A first valve element 140 is disposed slidably within the sleeve 110. A spring 149 is disposed in the sleeve 110 to urge the first valve element 140 into abutment with the stopper 120. The first valve element 140 is a cylindrical needle having a smaller-diameter central portion which defines a spill chamber 141 between itself and an inner wall of the sleeve 110. The spill chamber 141 communicates with the first sleeve hole 111 at all times.

The pressure of fuel lying between the fuel filter 12 and the suction control valve 7 is exerted on the end of the first valve element 140 facing the stopper 120. When such a pressure exceeds the first set pressure, it will cause, as illustrated in FIG. 3, the first valve element 140 to be moved toward the plug 130 against the pressure of the spring 149 to establish the fluid communication between the spill chamber 141 and the second sleeve hole 112.

In operation of the accumulator fuel injection system, when the diesel engine starts to run, it will cause the camshaft 61 of the high-pressure pump 6 to rotate, thereby transmitting the torque from the camshaft 61 to the feed pump 5. The feed pump 5 then pumps the fuel out of the fuel tank 4 through the inlet pipe 4*a*. The pumped fuel passes through the pre-filter 8 and the gauze filter 10 and enters the feed pump 5. The fuel, as discharged from the feed pump 5, flows through the fuel filter 12 and enters the suction control valve 7 through the fuel paths 5*a* and 12*a*.

The suction control valve 7 is controlled in the open position thereof by the control signal outputted from the ECU to deliver the fuel to the high-pressure pump 6 through the fuel path 7*a* at a flow rate needed to meet a required operating condition of the diesel engine.

The rotation of the cam 63 will cause the plungers 62 of the high-pressure pump 61 to reciprocate. When each of the plungers 62 is moved to the camshaft 61 within the cylinder, it will cause the volume of the pressure chamber 65 to increase, so that the pressure in the pressure chamber 65 drops. This causes the inlet valves 66 to be opened, so that the fuel, as discharged from the suction control valve 7, flows into the pressure chambers 65 through the fuel path 7*a* and the inlet paths 65*a*.

When each of the plungers 61 is moved away from the camshaft 61, it will cause the volume of the pressure chamber 65 to decrease, so that the pressure in the pressure chamber 65 rises. When the pressure in the pressure chamber 65 exceeds a level opening the outlet valves 67, the fuel is discharged from the pressure chambers 65 to the common rail 1 through the fuel paths 65*b* and 1*c*.

The fuel is stored in the common rail 1 in the manner, as described above, and sprayed into the diesel engine through the fuel injectors 2 when opened by the ECU.

When the pressure of fuel between the fuel filter 12 and the suction control valve 7 exceeds the first set pressure, it will cause, as already described with reference to FIG. 3, the first valve element 140 of the control valve 100 to be moved toward the plug 130 against the pressure of the spring 149 to establish the fluid communication of the spill chamber 141 with the first and second sleeve holes 111 and 112, in other words, to open the return path 14. This causes the part of the fuel between the feed pump 5 and the fuel filter 12 to be drained through the return path 14 (i.e., the first sleeve hole 111, the spill chamber 141, and the second sleeve hole 112) to upstream of the feed pump 5, thus resulting in a drop in pressure between the feed pump 5 and the fuel filter 12, so that the pressure of the fuel flowing upstream of the suction control valve 7 drops.

When the pressure of the fuel between the fuel filter 12 and the suction control valve 7 drops, it will cause the first valve element 140 to be urged by the spring 149 toward the stopper 120, so that the area of the path communicating between the spill chamber 141 and the second sleeve hole 112 decreases to decrease the flow rate of the fuel drained to upstream of the feed pump 5. When the pressure of the fuel between the fuel filter 12 and the suction control valve 7 drops below the first set pressure, it will block, as illustrated in FIG. 2, the fluid communication between the spill chamber 141 and the second sleeve hole 112, so that no fuel is drained to upstream of the feed pump 5. Specifically, when the flow rate of the fuel drained to upstream of the feed pump 5 is decreased, or the fuel is stopped completely to be drained to upstream of the feed pump 5, it results in a rise in pressure between the fuel filter 12 and the suction control valve 7.

In the above manner, the control valve 100 works to keep the pressure of the fuel between the fuel filter 12 and the section control valve 7 at the first set pressure. When the control valve 100 is in the open position, the flow rate of fuel passing through the fuel filter 12 will decrease.

Specifically, the control valve 100 serves as a pressure control valve to stabilize or keep the pressure of fuel between the fuel filter 12 and the section control valve 7 at a desired level and a relief valve to control the flow rate of fuel flowing into the fuel filter 12. The use of the control valve 100 improves the mountability of the fuel supply system in the vehicles without complexifying the structure and increasing the production cost thereof.

Figure 4:
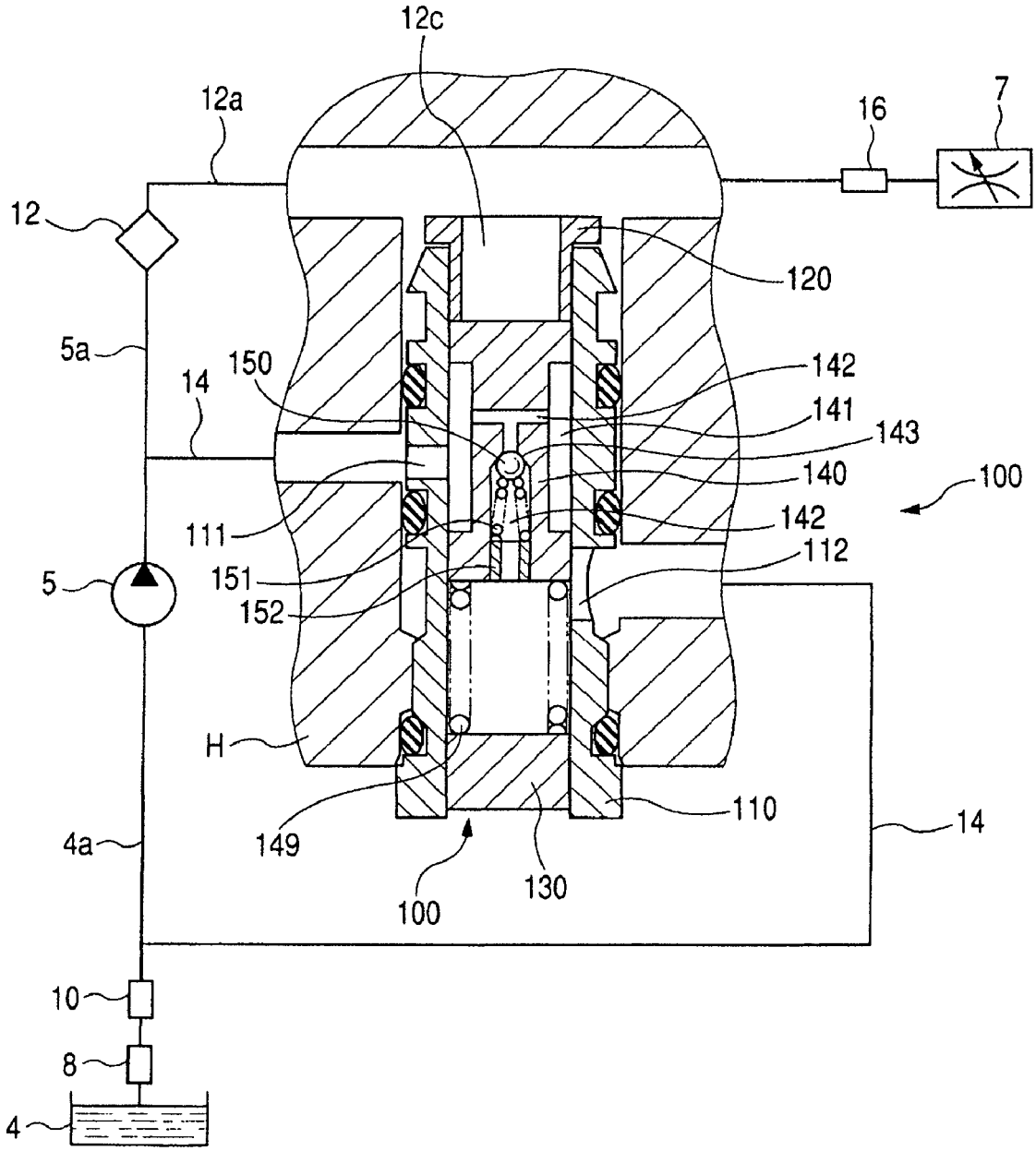
FIG. 4 is a partially sectional view which illustrates an internal structure of a control valve which is installed in a fuel supply system according to the second embodiment of the invention.

FIG. 4 illustrates the control valve 100 of a fuel supply system according to the second embodiment of the invention. The same reference numbers, as employed in the first embodiment, will refer to the same parts, and explanation thereof in detail will be omitted here.

The control valve 100 is designed to open the return path 14 when the pressure of fuel between the feed pump 5 and the fuel filter 12 exceeds a second set pressure.

The first valve element 140 has formed therein a T-shaped communicating hole 142 which has three open ends. Specifically, opposed two of the ends of the communicating hole 142 open into the spill chamber 141 and communicate with the return path 14 through the first sleeve hole 111, while the remaining one of the ends thereof opens at the end of the first valve element 140 facing the plug 130 and communicates with the return path 14 through the second sleeve hole 112. In other words, the communicating hole 142 defines a middle portion of the return path 14.

The first valve element 140 has disposed therein a ball valve 150 (i.e., a second valve element), a spring 151, and a spring retainer 152. The spring retainer 152 is made of a hollow cylindrical member which is press-fit in the end of the communicating hole 142. The spring 151 is disposed on an end of the spring retainer 152 so as to urge the ball valve 150 into constant abutment with a conical valve seat 143 to close the communicating hole 142.

The ball valve 150 is subjected to the pressure of fuel between the feed pump 5 and the fuel filter 12. When the pressure of fuel between the feed pump 5 and the fuel filter 12 exceeds the second set pressure, it will cause the ball valve 150 to be moved away from the valve seat 143 against the pressure of the spring 151 to establish fluid communication between the spill chamber 141 and the return path 14. The second set pressure is set to be higher than the first set pressure.

When the fuel filter 12 is clogged, it will result in an increase in loss of the pressure of fuel passing through the fuel filter 12. This will cause the pressure of fuel between the fuel filter 12 and the suction control valve 7 to drop, which may result in a failure in moving the first valve element 140, in other words, a failure of the first valve element 140 to serve as the relief valve to control the flow rate of fuel flowing into the fuel filter 12.

When the pressure of fuel between the feed pump 5 and the fuel filter 12, however, exceeds the second set pressure, the ball valve 150 opens the return path 14 to establish the fluid communication among the first sleeve hole 111, the spill chamber 141, the communicating hole 142, and the second sleeve hole 112, thereby releasing the pressure of fuel between the feed pump 5 and the fuel filter 12 to upstream of the feed pump 5. This will result in a drop in pressure of fuel between the feed pump 5 and the fuel filter 12, thus avoiding an undesirable elevation of the pressure of fuel acting on the fuel filter 12.

Figure 5:
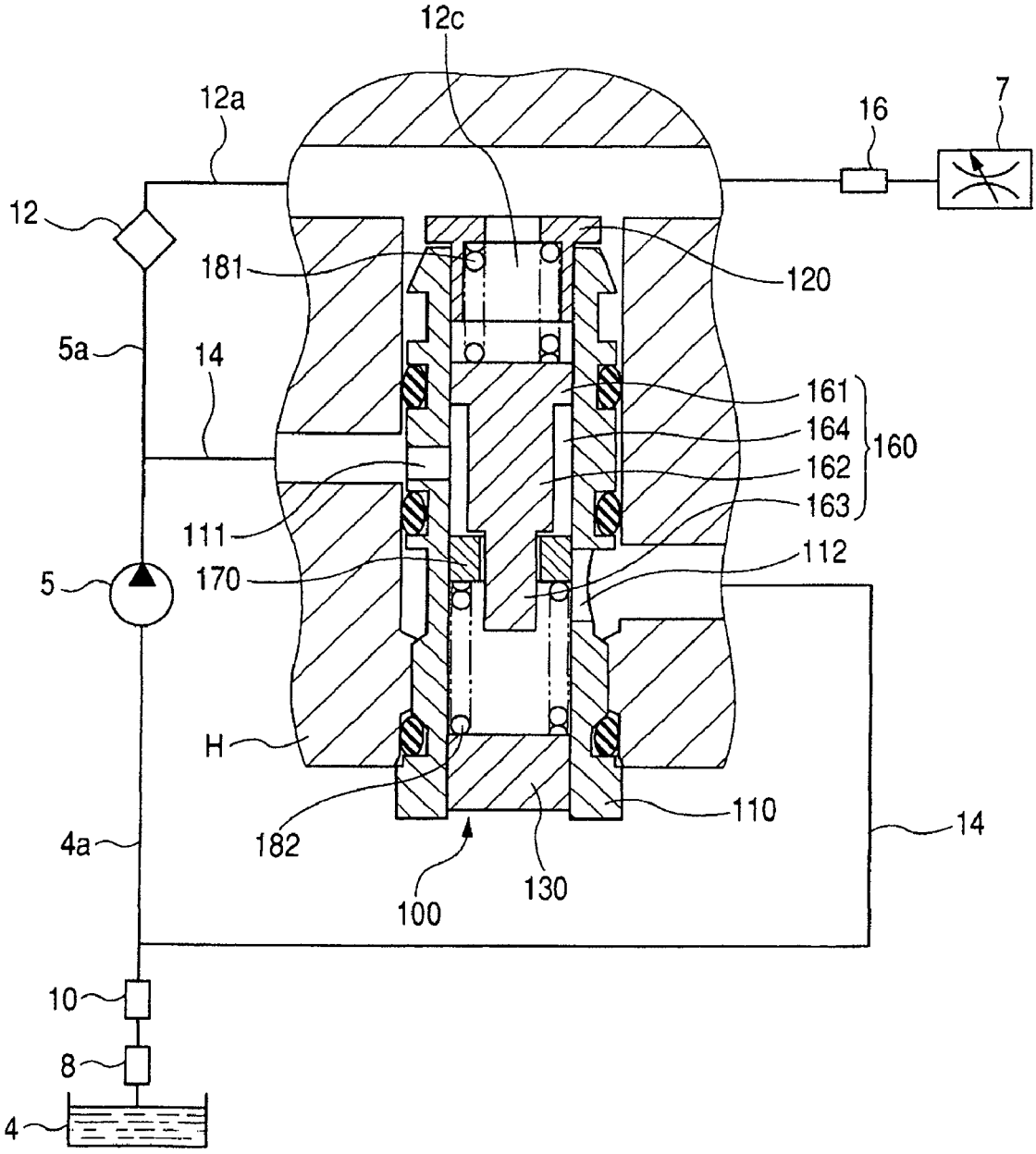
FIG. 5 is a partially sectional view which illustrates an internal structure of a control valve which is installed in a fuel supply system according to the third embodiment of the invention and placed in a closed position.
Figure 6:
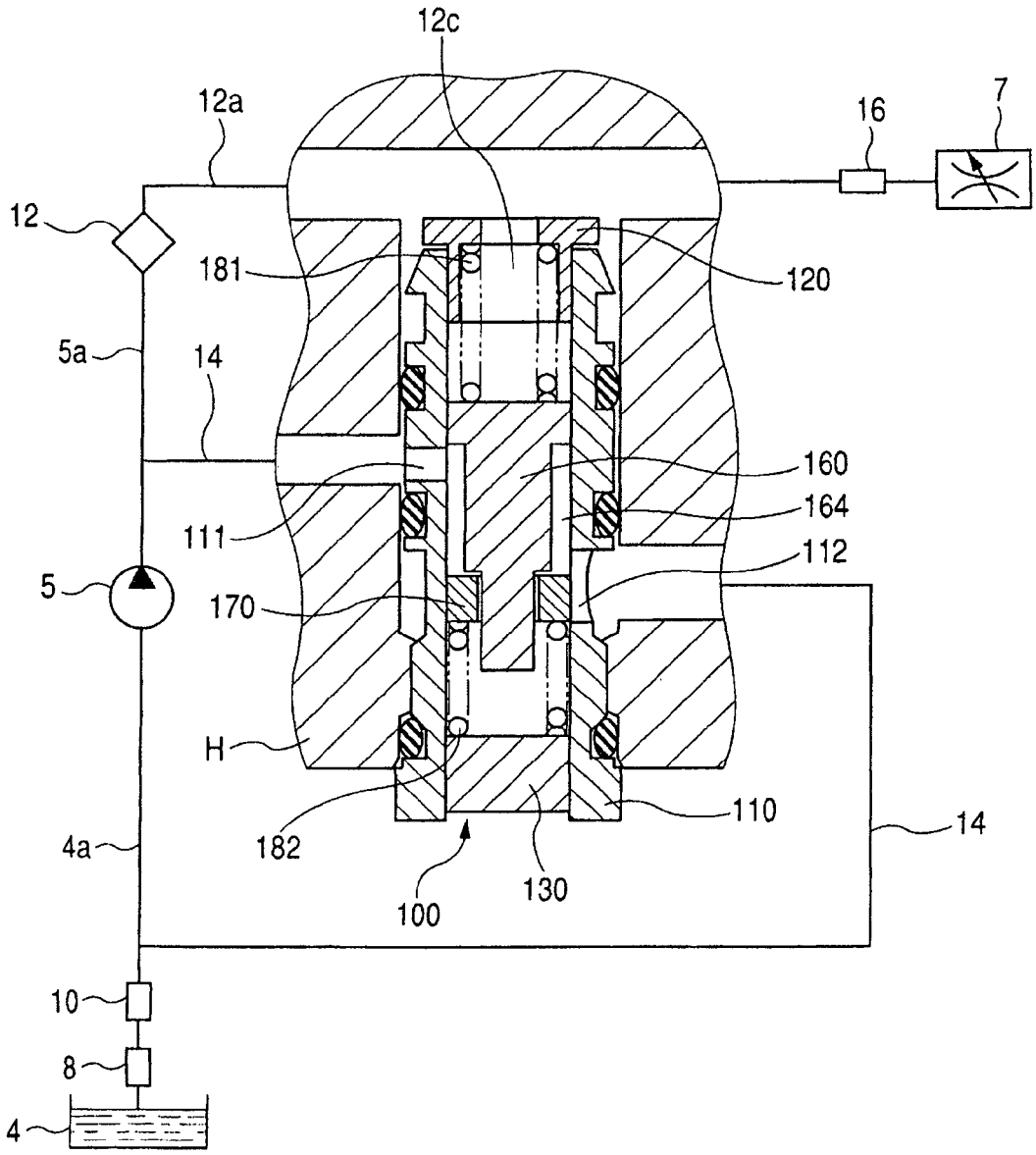
FIG. 6 is a partially sectional view of the control valve in FIG. 5 which is placed in an open position when the pressure of fuel lying downstream of a fuel filter rises.
Figure 7:
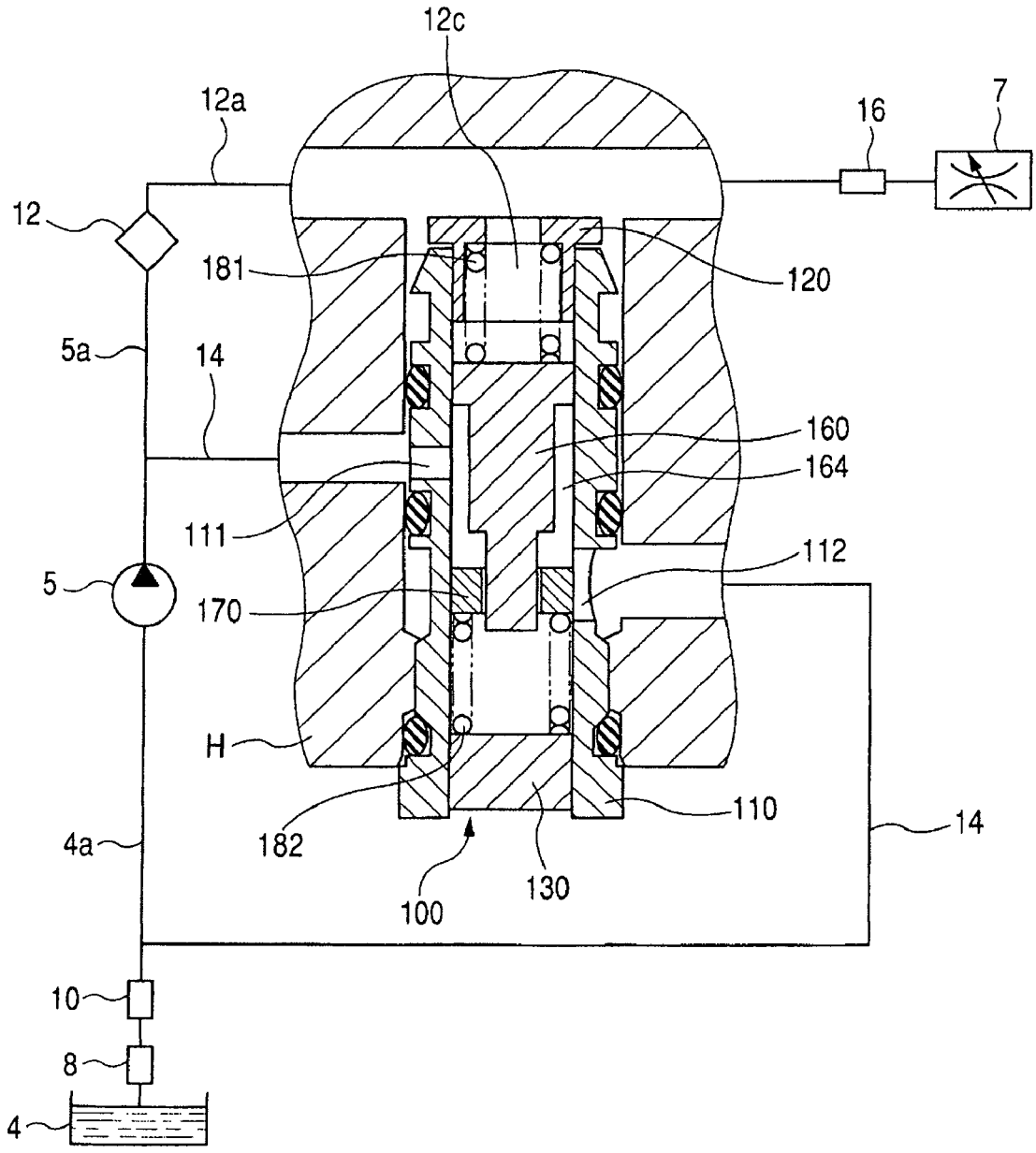
FIG. 7 is a partially sectional view of the control valve in FIG. 5 which is placed in an open position when the pressure of fuel lying upstream of a fuel filter rises.

FIGS. 5, 6, and 7 illustrate the control valve 100 of a fuel supply system according to the third embodiment of the invention. The same reference numbers, as employed in the first embodiment, will refer to the same parts, and explanation thereof in detail will be omitted here.

The control valve 100 is, like in the second embodiment, designed to open the return path 14 when the pressure of fuel between the feed pump 5 and the fuel filter 12 exceeds the second set pressure, but has an internal structure different from that in the second embodiment.

The control valve 100 is equipped with a first valve element 160 which has a length made up of a first cylindrical body (i.e., a flange) 161, a second cylindrical body (i.e., a stem) 162, and a third cylindrical body (i.e., a needle) 163. The first cylindrical body 161 is formed on an end of the second cylindrical body 162 which faces the stopper 120. The third cylindrical body 163 extends from the other end of the second cylindrical body 162 toward the plug 130. The second cylindrical body 162 is smaller in diameter than the first cylindrical body 161. The third cylindrical body 163 is smaller in diameter than the second cylindrical body 162. The end of the first cylindrical body 161 is exposed to the pressure of fuel between the fuel filter 12 and the suction control valve 7. The second cylindrical body 162 defines a spill chamber 164 between an outer periphery thereof and an inner wall of the sleeve 110. The spill chamber 164 communicates with the first sleeve hole 111 at all the time.

The control valve 100 is also equipped with a ring-shaped second valve element 170 which is fit on the third cylindrical body 163 slidably. The second valve element 170 is greater in outer diameter than the second cylindrical body 162 and identical with the first cylindrical body 161. The second valve element 170 is exposed at an end thereof to the pressure of fuel between the feed pump 5 and the fuel filter 12.

A first spring 181 is disposed between the stopper 120 and the end of the first cylindrical body 161 to urge the first cylindrical body 160 into abutment with the second valve element 170. Similarly, a second spring 182 is disposed between the plug 130 and the second valve element 170 to urge the second valve element 170 into abutment with the first valve element 160.

When the pressure of fuel between the fuel filter 12 and the suction control valve 7 exceeds the first set pressure, it will cause, as illustrated in FIG. 6, the first valve element 160 to be moved downward to the plug 130 together with the second valve element 170 against the urging of the second spring 182, thereby establishing the fluid communication of the spill chamber 164 with the first and second sleeve holes 111 and 112 to open the return path 14. This causes the part of the fuel between the feed pump 5 and the fuel filter 12 to be released to upstream of the feed pump 5.

When the fuel is released from between the fuel pump 5 and the fuel filter 12, the pressure therebetween drops, resulting in a drop in pressure between the fuel filter 12 and the suction control valve 7. This will cause the first and second valve elements 160 and 170 to be urged by the second spring 182 toward the stopper 120, so that the area of the path communicating between the spill chamber 164 and the second sleeve hole 112 decreases to decrease the flow rate of the fuel drained to upstream of the feed pump 5. When the pressure of the fuel between the fuel filter 12 and the suction control valve 7 drops below the first set pressure, it will block, as illustrated in FIG. 5, the fluid communication between the spill chamber 164 and the second sleeve hole 112, so that no fuel is drained to upstream of the feed pump 5. Specifically, when the flow rate of the fuel drained to upstream of the feed pump 5 is decreased, or the fuel is stopped completely from being drained to upstream of the feed pump 5, it results in a rise in pressure between the fuel filter 12 and the section control valve 7.

In the above manner, the control valve 100 works to keep the pressure of the fuel between the fuel filter 12 and the section control valve 7 at the first set pressure.

When the fuel filter 12 is clogged, so that the pressure of fuel between the feed pump 5 and the fuel filter 12 rises above the second set pressure, it will cause, as illustrated in FIG. 7, the second valve element 170 to be moved away from the first valve element 160 against the urging of the second spring 182, thereby establishing the fluid communication of the spill chamber 164 with the first and second sleeve holes 111 and 112 to open the return path 14. This causes the part of the fuel between the feed pump 5 and the fuel filter 12 to be released to upstream of the feed pump 5, thus avoiding an undesirable elevation of the pressure of fuel acting on the fuel filter 12.

Figure 8:
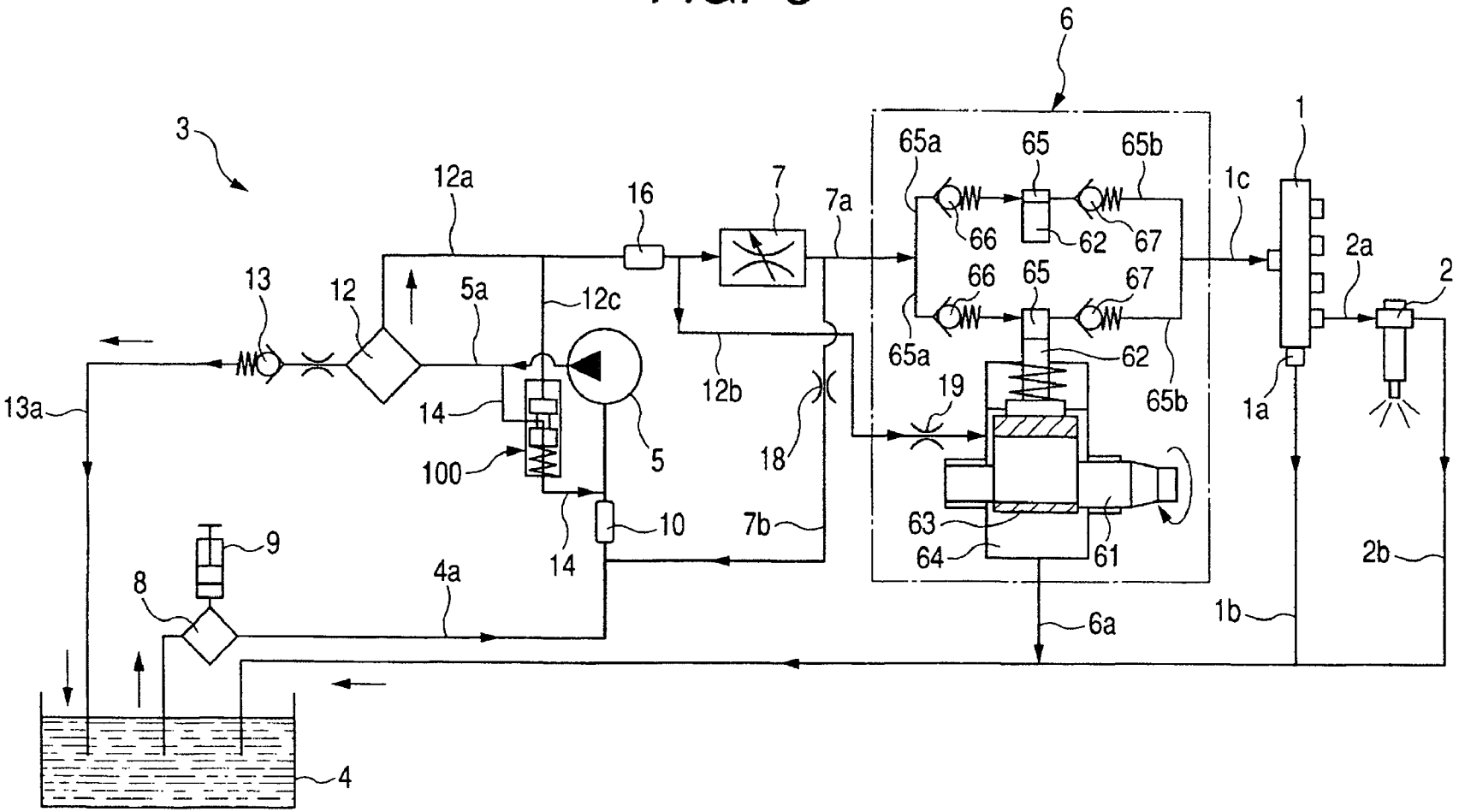
FIG. 8 is a block diagram which shows an accumulator fuel injection system equipped with a fuel supply system according to the fourth embodiment of the invention.

FIG. 8 illustrates an accumulator fuel injection system for automotive diesel engines equipped with a fuel supply system 3 according to the fourth embodiment of the invention. The same reference numbers as employed in the above embodiments will refer to the same parts, and explanation thereof in detail will be omitted here.

The fuel supply system 3 is designed to have the return path 14 connecting at an end thereof to between the feed pump 5 and the fuel filter 12 and at the other end thereof to between the priming pump 9 and the feed pump 5. The fuel supply system 3 does not have the bypass pat 4*b* and the check valve 11 which are used in the first embodiment.

Figure 9:
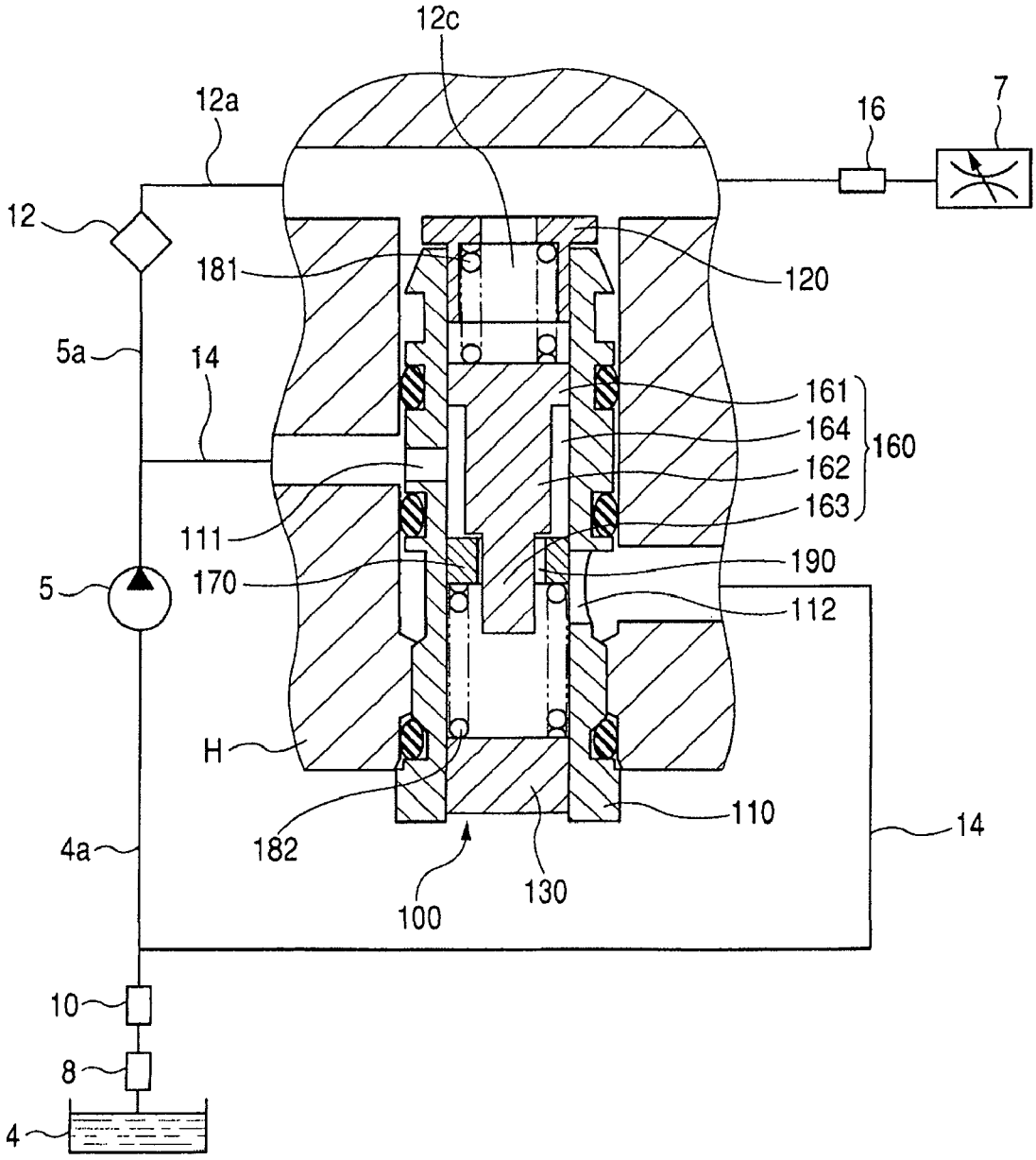
FIG. 9 is a partially enlarged view which shows an internal structure of a control valve installed in the fuel supply system of FIG. 8.
Figure 10A:
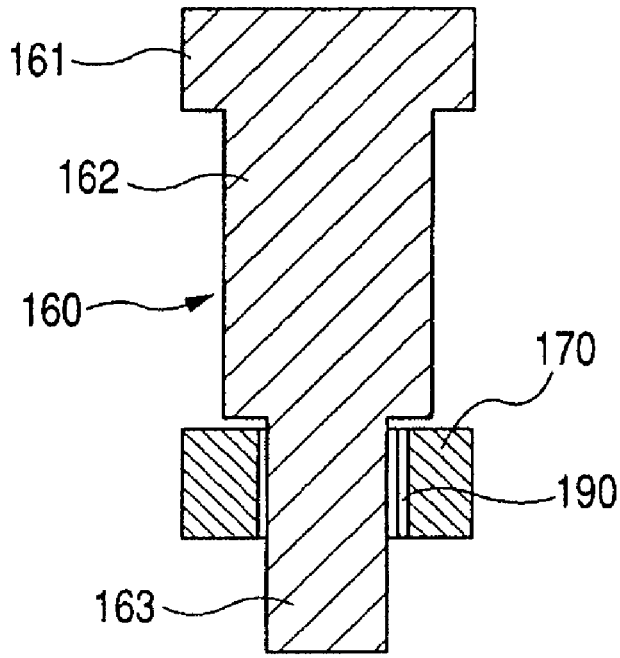
FIG. 10(*a*) is a longitudinal sectional view which illustrates a first and a second valve element installed in the control valve of FIG. 9.
Figure 10B:
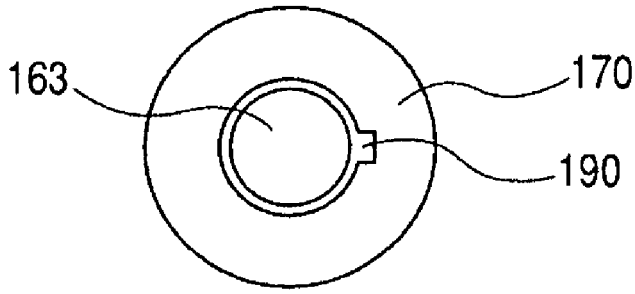

FIG. 9 is a partially enlarged view which shows an internal structure of the control valve 100 installed in the fuel supply system 3 of FIG. 8. FIG. 10(*a*) is a longitudinal sectional view which illustrates the first and second valve elements 160 and 170 installed in the control valve 100 of FIG. 9. FIG. 10(*b*) is a bottom view of FIG. 10(*a*).

The control valve 100 is designed to have the second valve element 170 in which a communicating path 190 is formed. The communicating path 190 connects at ends thereof with the return path 14. Specifically, the communicating path 190 is defined by a groove which is formed in an inner side wall of the second valve element 170 and extends vertically through the thickness of the second valve element 170. The communicating path 190 is to communicate with the spill chamber 164 and leads to the second sleeve hole 112 at all the time. When the second cylindrical body 162 is placed in abutment with the second valve element 170, the fluid communication between the communicating path 190 and the spill chamber 164 is blocked by a shoulder (i.e., the annular end) of the second cylindrical body 162. Alternatively, when the second cylindrical body 162 is away from the second valve element 170, the fluid communication between the communicating path 190 and the spill chamber 164 is established.

Figure 11:
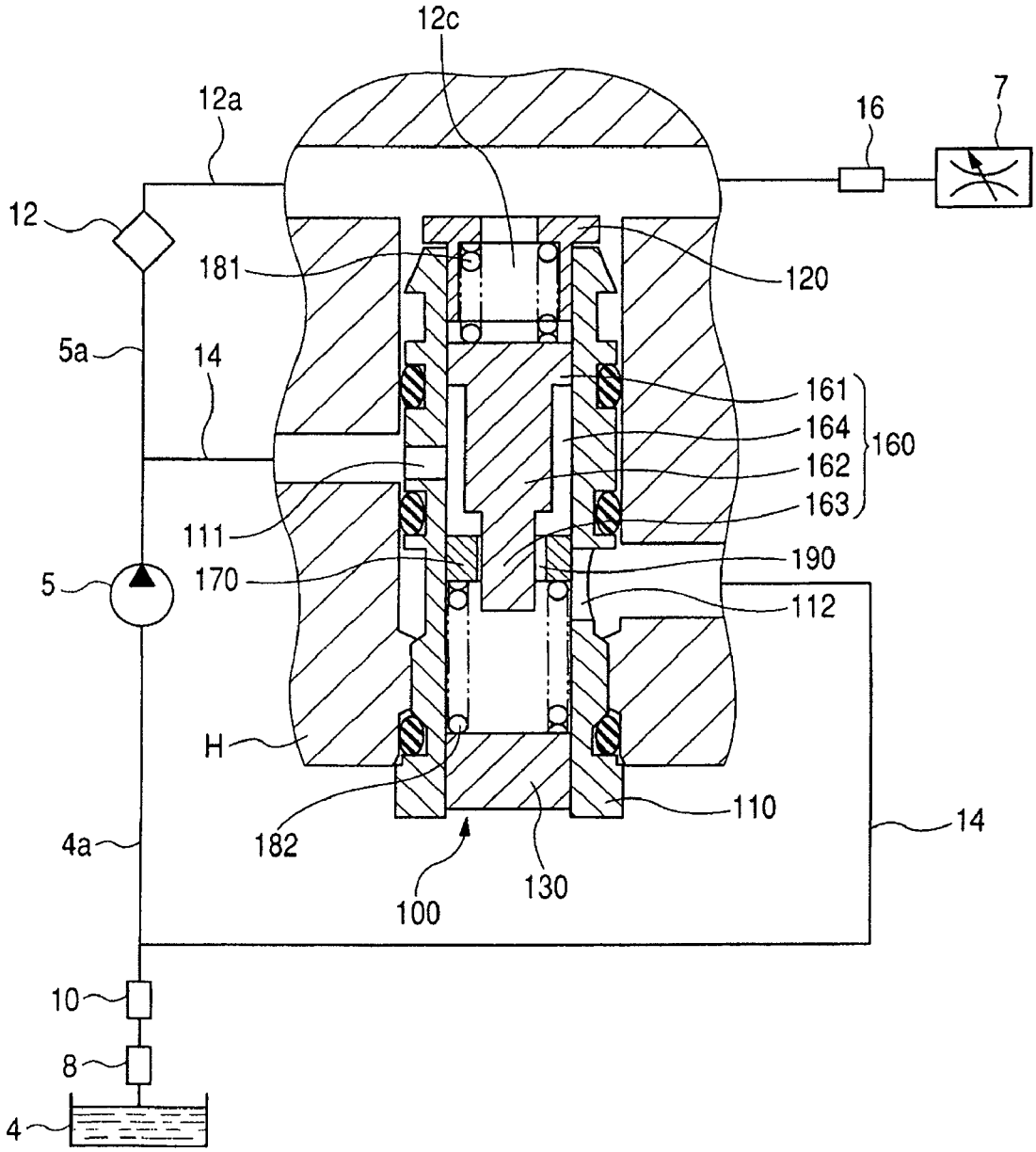
FIG. 11 is a partially enlarged view which shows the control valve installed of FIG. 9 which is placed in an open position.

When the fuel is pumped out of the fuel tank 4 by the priming pump 9, the pressure of the fuel is exerted on the end of the second cylindrical body 162 abutting on the second valve element 170 through the inlet pipe 4*a*, the return path 14, the second sleeve hole 112, and the communicating path 190. This causes, as illustrated in FIG. 11, the first valve element 160 to be moved away from the second valve element 170 against the urging of the first spring 181, thereby establishing the fluid communication between the communicating path 190 and the spill chamber 164. The fuel, as pumped by the priming pump 9, then flows from the inlet pipe 4*a* to the return path 14, to the second sleeve hole 112, to the communicating path 190, to the spill chamber 164, to the first sleeve hole 111, to the return path 14, and to the fuel filter 12. Specifically, the fuel is primed into the fuel filter 12 without use of the bypass path 4*b* and the check valve 11 as employed in the first embodiment.

Figure 12A:
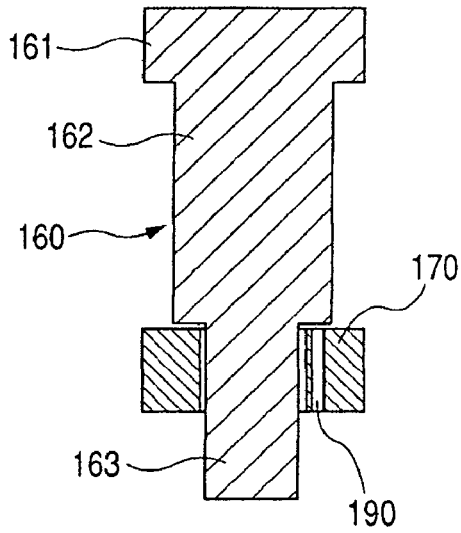
FIG. 12(*a*) is a longitudinal sectional view which illustrates the first modification of the control valve in the fourth embodiment of the invention.
Figure 12B:
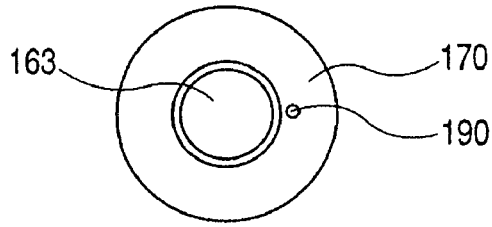

The communicating path 190 may also be, as illustrated in FIGS. 12(*a*) and 12(*b*), defined by a circular hole extending through the thickness of the second valve element 170 in an axial direction thereof.

Figure 13A:
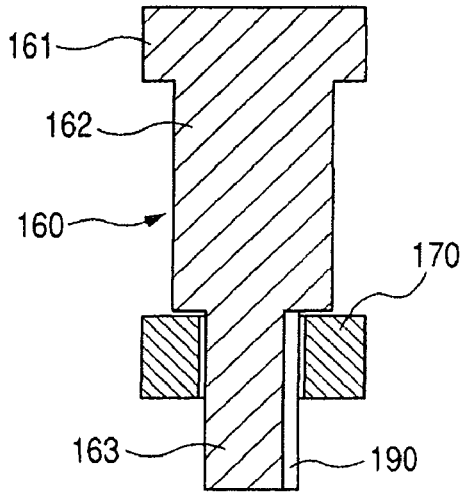
FIG. 13(*a*) is a longitudinal sectional view which illustrates the second modification of the control valve in the fourth embodiment of the invention.
Figure 13B:
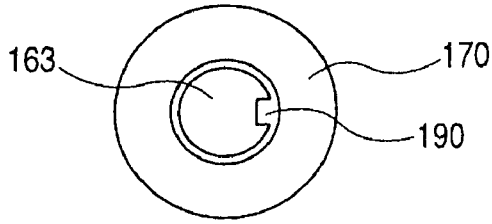

The communicating path 190 may alternatively be, as illustrated in FIGS. 13(*a*) and 13(*b*), defined by a groove such as a key groove formed in an outer periphery of the third cylindrical body 163 of the first valve element 160.

Figure 14A:
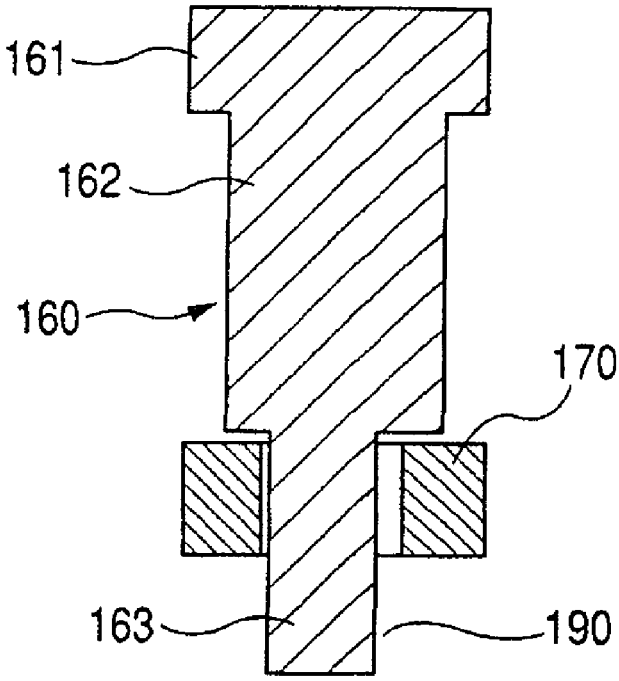
FIG. 14(*a*) is a longitudinal sectional view which illustrates the third modification of the control valve in the fourth embodiment of the invention.
Figure 14B:
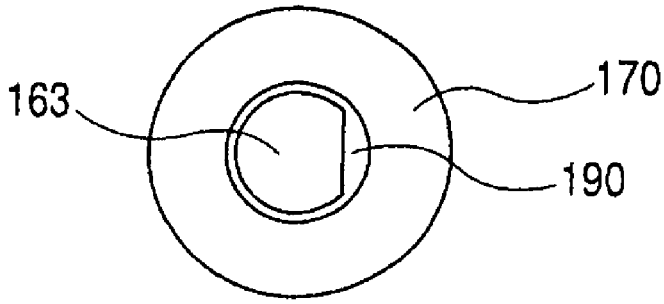

The communicating path 190 may alternatively be, as illustrated in FIGS. 14(*a*) and 14(*b*), provided by a falcate clearance defined by the inner periphery of the second valve element 170 and a flat surface of the third cylindrical body 163 formed by grinding a longitudinal portion of the outer periphery of the third cylindrical body 163.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A fuel supply system for an accumulator fuel injection system designed to inject fuel, as stored in an accumulator, into an internal combustion engine through a fuel injector comprising:

a feed pump working to pump fuel out of a fuel tank through a first fuel path and feed the fuel to a second fuel path;

a high-pressure pump working to pressurize and supply the fuel, as fed from said feed pump through the second fuel path, to an accumulator;

a fuel filter disposed in the second fuel path between said feed pump and the high-pressure pump to filter the fuel, as delivered from said feed pump to said high-pressure pump;

a flow rate control valve disposed in the second fuel path between said fuel filter and said high-pressure pump, said flow rate control valve working to control a flow rate of the fuel delivered to said high-pressure pump;

a return path extending from between said feed pump and said fuel filter to the first fuel path which is upstream of said feed pump; and a control valve working to open and close said return path selectively, when a pressure of the fuel in the second fuel path between said fuel filter and said flow rate control valve exceeds a first set pressure, said control valve being placed in an open position to open said return path to return the fuel from downstream to upstream of said feed pump to keep the pressure of fuel between said fuel filter and said flow rate control valve below the first set pressure.

2. A fuel supply system as set forth in claim 1, wherein said control valve includes a first valve element and a second valve element, the first valve element being subjected to the pressure of the fuel between said fuel filter and said flow rate control valve, when the pressure of the fuel between said fuel filter and said flow rate control valve exceeds the first set pressure, the first valve element being moved to open said return path, the second valve element being subjected to a pressure of the fuel between said feed pump and said fuel filter, when the pressure of the fuel between said feed pump and said fuel filter exceeds a second set pressure, the second valve element being moved to open said return path.

3. A fuel supply system as set forth in claim 2, wherein the first valve element has a communicating hole formed therein as a portion of said return path, and wherein the second valve element is disposed in the communicating hole to open and close said return path selectively.

4. A fuel supply system as set forth in claim 2, wherein the first valve element has a length made up of a first cylindrical body, a second cylindrical body, and a third cylindrical body, the second cylindrical body being located between the first and third cylindrical bodies and smaller in diameter than the first cylindrical body, the third cylindrical body being smaller in diameter than the second cylindrical body, wherein the second valve element is made of a ring-shaped member which is greater in outer diameter than the second cylindrical body and in which the third cylindrical body is fit slidably, wherein said control valve includes a first spring urging said first valve element toward said second valve element and a second spring urging said second valve element toward said first valve element, wherein an end of the first cylindrical body is exposed to the pressure of the fuel between said fuel filter and said flow rate control valve, an end of the second valve element being exposed to the pressure of the fuel between said feed pump and said fuel filter, wherein when the pressure of the fuel between said fuel filter and said flow rate control valve exceeds the first set pressure, said first and second valve elements are moved together to open said return path, when the pressure of the fuel between said feed pump and said fuel filter exceeds the second set pressure, said second valve element being moved away from said first valve element to open said return path.

5. A fuel supply system as set forth in claim 4, further comprising a priming pump which is disposed in the first fuel path between the fuel tank and said feed pump and works to pump the fuel out of the fuel tank and feed the fuel, wherein said return path serves to return the fuel from between said feed pump and said fuel filter to between said priming pump and said feed pump, wherein one of the third cylindrical body of the first valve element and the second valve element has a communicating path which is to communicate at ends thereof with said return path, wherein when the second cylindrical body of said first valve element is placed in abutment with said second valve element, the communicating path is closed, when the second cylindrical body of said first valve element is placed away from said second valve element, the communicating path being opened, and wherein the second cylindrical body has an outer shoulder surface which faces said second valve element and on which a pressure of the fuel, as fed from said priming pump, is exerted through the communicating path, so that the pressure of the fuel, as fed from said priming pump, urges the second cylindrical body of said first valve element away from said second valve element to open said return path through the communicating path.

* * * * *